US011443630B2

(12) United States Patent
Shimamoto et al.

(10) Patent No.: US 11,443,630 B2
(45) Date of Patent: Sep. 13, 2022

(54) ACCOMMODATION AREA MANAGEMENT DEVICE

(71) Applicant: HONDA MOTOR CO., LTD., Tokyo (JP)

(72) Inventors: Gaku Shimamoto, Saitama (JP); Junpei Noguchi, Saitama (JP); Yuta Takada, Tokyo (JP); Ryoma Taguchi, Tokyo (JP); Shogo Kobayashi, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/204,289

(22) Filed: Mar. 17, 2021

(65) Prior Publication Data

US 2021/0295699 A1 Sep. 23, 2021

(30) Foreign Application Priority Data

Mar. 19, 2020 (JP) ..... JP2020-050294

(51) Int. Cl.
*G08G 1/14* (2006.01)

(52) U.S. Cl.
CPC ..... *G08G 1/148* (2013.01); *G08G 1/142* (2013.01); *G08G 1/146* (2013.01)

(58) Field of Classification Search
None
See application file for complete search history.

(56) References Cited

U.S. PATENT DOCUMENTS

2019/0126765 A1* 5/2019 Seo ..... G05D 1/0225

FOREIGN PATENT DOCUMENTS

JP 2012-215923 A 11/2012

* cited by examiner

*Primary Examiner* — John F Mortell
(74) *Attorney, Agent, or Firm* — Paratus Law Group, PLLC

(57) ABSTRACT

A parking lot management device which manages a parking lot for accommodating a vehicle and stops the vehicle at a predetermined accommodation position in the parking lot, includes a priority assigning unit which assigns a priority to each of a plurality of moving bodies traveling in the parking lot according to an order in which each vehicle is traveled. The priority assigning unit assigns the priority to each vehicle according to a moving destination of each vehicle in the parking lot.

11 Claims, 6 Drawing Sheets

446

| PARKING SPACE ID | STATUS | VEHICLE ID | ENTRY TIME | SCHEDULED EXIT TIME |
|---|---|---|---|---|
| 001 | EMPTY | — | — | — |
| 002 | FULL | KH003A | 2018/12/1 14:30 | 2018/12/1 17:00 |
| 003 | EMPTY | — | — | — |
| ⋮ | ⋮ | ⋮ | ⋮ | ⋮ |

ACCOMMODATION AREA MANAGEMENT DEVICE

CROSS-REFERENCE TO RELATED APPLICATIONS

The present application claims the benefit of priority of Japanese Patent Application No. 2020-050294, filed on Mar. 19, 2020, the content of which is incorporated herein by reference.

TECHNICAL FIELD

The present invention relates to an accommodation area management device which manages an accommodation area which can accommodate a moving body.

BACKGROUND

In a recent year, a technique related to reservation management of a parking lot is disclosed in which when a user requests a reservation, it is determined whether the reservation can be accepted, and when it is determined that the reservation cannot be accepted, another user is urged to make a vehicle exit from a parking lot, and further when it is approved to make the vehicle exit, the reservation is executed (see, for example, JP-A-2012-215923).

SUMMARY

However, in the technique or the related art, a technique for moving a moving body such as a vehicle in a predetermined accommodation area such as a parking lot has not been sufficiently studied. In particular, a technique for appropriately moving a plurality of moving bodies in the accommodation area has not been sufficiently studied. When a plurality of moving bodies move in the accommodation area, it is considered that congestion is likely to occur in the accommodation area, and thus it is necessary to efficiently move the moving bodies in the accommodation area.

The present embodiment provides an accommodation area management device capable of appropriately moving a plurality of moving bodies in an accommodation area and suppressing occurrence of congestion.

An aspect of the present embodiment is an accommodation area management device which manages an accommodation area for accommodating a moving body and stops the moving body at a predetermined accommodation position in the accommodation area, comprising:

a priority assigning unit which assigns a priority to each of a plurality of moving bodies traveling in the accommodation area according to an order in which each moving body is traveled, wherein the priority assigning unit assigns the priority to each moving body according to a moving destination of each moving body in the accommodation area.

According to the present embodiment, it is possible to appropriately move a plurality of moving bodies in an accommodation area.

DESCRIPTION OF EMBODIMENT

Hereinafter, an embodiment of an accommodation area management device of the present invention will be described with reference to the accompanying drawings. In the following embodiment, an example will be described in which a moving body in the present invention is a vehicle and an accommodation area in the present invention is a parking lot. Further, in the following embodiment, an example in which the accommodation area management device of the present invention is used as a parking lot management device for managing a parking lot will be described.

Vehicle System

Figure 1:
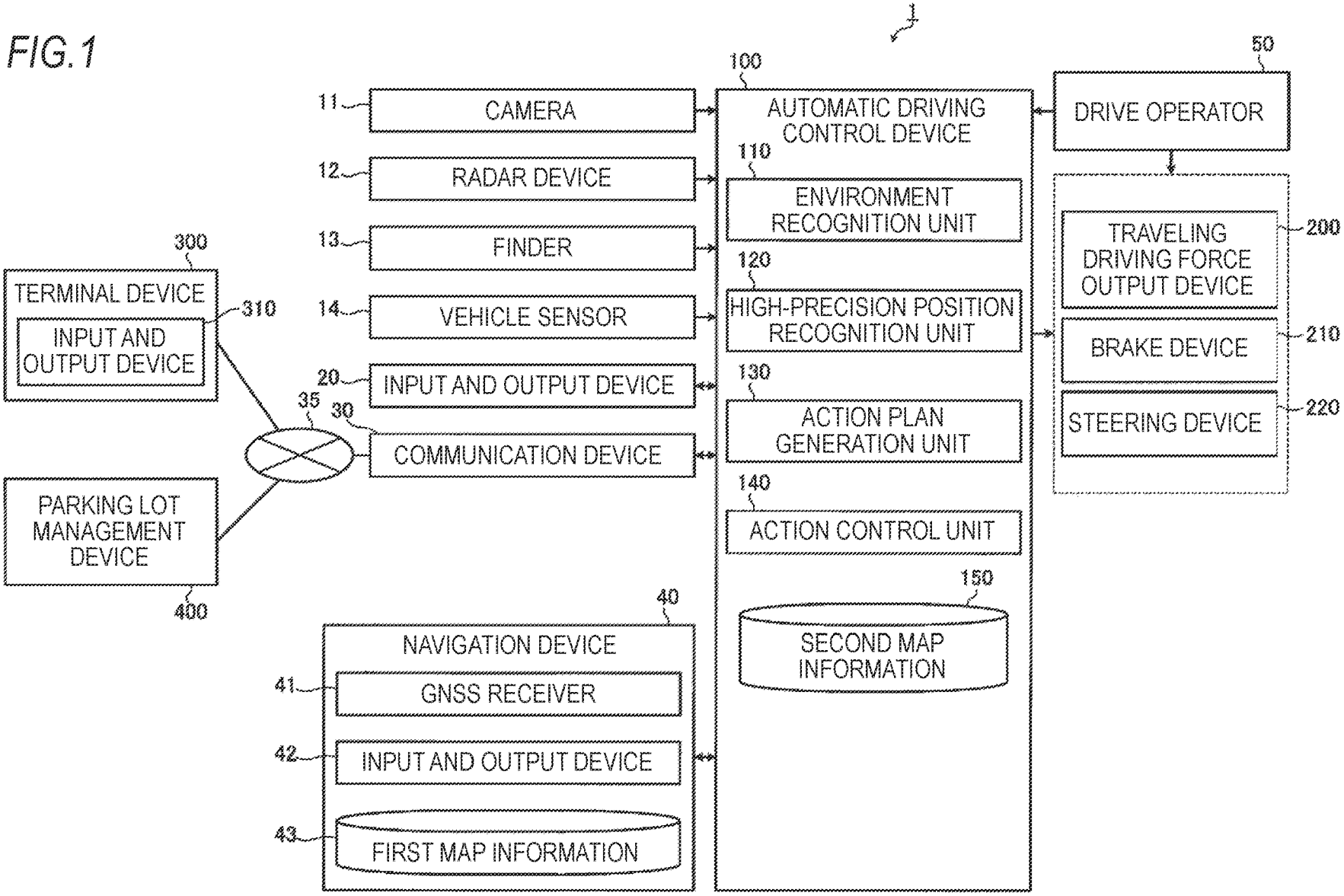
FIG. 1 is a diagram illustrating an example of a configuration of a vehicle system of an embodiment.

First, a vehicle of the embodiment will be described. In FIG. 1, a vehicle system 1 is mounted on a vehicle having an automatic driving function of a so-called automatic driving level "4" or higher. A vehicle (hereinafter, also referred to as vehicle M) equipped with the vehicle system 1 is a vehicle including a drive source (for example, a traveling driving force output device 200 described below) and wheels (for example, two wheels, three wheels, or low-wheels) including driving wheels driven by the power of the drive source. The drive source of the vehicle M is, for example, an electric motor. Further, the drive source of the vehicle M may be an internal combustion engine such as a gasoline engine or a combination of an electric motor and an internal combustion engine.

As illustrated in FIG. 1, the vehicle system 1 includes a camera 11, a radar device 12, a finder 13, a vehicle sensor 14, an input and output device 20, a communication device 30, a navigation device 40, a drive operator 50, an automatic driving control device 100, the traveling driving force output device 200, a brake device 210, a steering device 220. Each of those devices is communicably connected to each other by a wired or wireless communication network. The communication network connecting each of those devices is, for example, Controller Area Network (CAN).

The camera 11 is a digital camera which photographs the periphery (for example, in front of vehicle M) of the vehicle M and outputs image data obtained by the photographing to the automatic driving control device 100. The radar device 12 is, for example, a radar device using radio waves in a millimeter wave band, detects a position of an object in the vicinity (for example, in front of, behind, and to the side of vehicle M) of the vehicle M, and outputs the detection result to the automatic driving control device 100.

The finder 13 is, for example, Laser Imaging Detection and Ranging (LIDAR). The finder 13 uses a predetermined laser beam to measure the distance to an object (target object) around (for example, in front of, behind, and to the side of vehicle M) the vehicle M and outputs the measurement result to the automatic driving control device 100.

The vehicle sensor 14 includes, for example, a vehicle speed sensor which detects the speed of the vehicle M, an acceleration sensor which detects the acceleration of the vehicle M, an angular velocity sensor which detects the angular velocity around a vertical axis of the vehicle M, an orientation sensor which detects the orientation of the vehicle M, and the like. Further, the vehicle sensor 14 includes a radio wave intensity sensor which detects the radio wave intensity (that is, the communication intensity) of the radio wave used by the communication device 30, described later, for communication. The vehicle sensor 14 outputs the detection result of each sensor to the automatic driving control device 100 or the like.

The input and output device 20 includes an output device which outputs various kinds of information to a user of the vehicle M and an input device which accepts various input operations from the user of the vehicle M. The output device of the input and output device 20 is, for example, a display which displays based on a processing result of the automatic driving control device 100. The output device may be a speaker, a buzzer, an indicator light, or the like. The input device of the input and output device 20 is, for example, a touch panel or an operation button (key, switch, or the like) which outputs an operation signal corresponding to an input operation received from a user to the automatic driving control device 100.

The communication device 30 is connected to a network 35 and communicates with another device provided outside the vehicle system 1 via the network 35. The network 35 includes, for example, a mobile communication network, a Wi-Fi network, Bluetooth (registered trademark), Dedicated Short Range Communication (DSRC), and the like.

The communication device 30 communicates with, for example, a terminal device 300 carried by a user of the vehicle M, a parking lot management device 400 which manages a parking lot PA where the vehicle M can be parked. The terminal device 300 is, for example, a smartphone or a tablet terminal and is an electronic device connected to the network 35 and including an input and output device 310. The input and output device 310 is, for example, a display which displays various information to a user, a touch panel which accepts a user's input operation, and the like. The parking lot PA and the parking lot management device 400 will be described below.

The navigation device 40 includes a Global Navigation Satellite System (GNSS) receiver 41 and an input and output device 42. Further, the navigation device 40 includes a storage device (not illustrated) such as a flash memory and first map information 43 is stored in this storage device. The first map information 43 is, for example, information representing a road shape by a link indicating a road and a node connected by the link. Further, the first map information 43 may include information representing the curvature of the road and the Point Of Interest (POI).

The GNSS receiver 41 identifies the latitude and longitude of a point where the vehicle M is located as the position of the vehicle M based on the signal received from the GNSS satellite. Further, the navigation device 40 may specify or correct the position of the vehicle M by an Inertial Navigation System (INS) using the output of the vehicle sensor 14.

The input and output device 42 includes an output device which outputs various kinds of information to a user of the vehicle M and an input device which accepts various input operations from a user of the vehicle M. The output device of the input and output device 42 is, for example, a display which displays (for example, displays a route on a map described below) based on the processing result of the navigation device 40. Further, the input device of the input and output device 42 is, for example, a touch panel or an operation button (key, switch, or the like) which outputs an operation signal corresponding to the input operation received from a user to the navigation device 40. The input and output device 42 may be shared with the input and output device 20.

For example, the navigation device 40 determines a route (hereinafter, also referred to as a route on the map) from the position of the vehicle M specified by the GNSS receiver 41 to a destination input by the user with reference to the first map information 43. Then, the navigation device 40 guides the determined route on the map to the user by the input and output device 42. Further, the navigation device 40 outputs information indicating the position of the vehicle M specified by the GNSS receiver 41 and information indicating the determined route on the map to the automatic driving control device 100.

The navigation device 40 may be realized by the function of the terminal device 300. Also, for example, the communication device 30 may transmit information indicating the position of the vehicle M and the destination input by a user to a server device (navigation server) outside the vehicle system 1 and the function of the navigation device 40 may be realized by this server device.

The drive operator 50 is various operators such as an accelerator pedal, a brake pedal, a shift lever, a steering wheel, a deformed steering wheel, and a joystick. The drive operator 50 is provided with a sensor which detects the amount of operation or the presence or absence of operation on the drive operator 50. The detection result by the sensor of the drive operator 50 is output to a part or all of the automatic driving control device 100, the traveling driving force output device 200, the brake device 210, and the steering device 220.

The traveling driving force output device 200 outputs a traveling driving force (torque) for the vehicle M to travel to the driving wheels. The traveling driving force output device 200 includes, for example, an electric motor and an electric motor Electronic Control Unit (ECU) which controls the electric motor. The electric motor ECU controls the electric motor based on the detection result by the sensor of the drive operator 50 (for example, the accelerator pedal) and the control information from the automatic driving control device 100. Further, when the vehicle M includes an internal combustion engine or a transmission as a drive source, the traveling driving force output device 200 may include an internal combustion engine or a transmission and an ECU for controlling the combustion engine or the transmission.

The brake device 210 includes, for example, a brake caliper, a cylinder which transmits hydraulic pressure to the brake caliper, an electric motor which generates hydraulic pressure in the cylinder, and a brake ECU. Based on the detection result by the sensor of the drive operator 50 (for example, the brake pedal) and the control information from the automatic driving control device 100, the brake ECU controls the electric motor of the brake device 210 so that the brake torque corresponding to the braking operation is output to each wheel.

The steering device 220 includes, for example, a steering ECU and an electric motor. The electric motor of the steering device 220, for example, applies a force to the rack and pinion mechanism to change the direction of the steering wheel. Based on the detection result by the sensor of the drive operator 50 (for example, the steering wheel) and the control information from the automatic driving control device 100, the steering ECU drives the electric motor of the steering device 220 to change the direction of the steering wheels.

Automatic Driving Control Device

The automatic driving control device 100 includes an environment recognition unit 110, a high-precision position recognition unit 120, an action plan generation unit 130, and an action control unit 140. Further, the automatic driving control device 100 includes a storage device (not illustrated) realized by a flash memory or the like to which each functional unit (for example, high-precision position recognition unit 120) of the automatic driving control device 100 can access and a second map information 150 is stored in this storage device.

The second map information 150 is more accurate map information than the first map information 43. The second map information 150 includes, for example, information indicating the center of a lane, information indicating a lane boundary line (for example, a road lane marking), and the like. Further, the second map information 150 may include road information, traffic regulation information, address information, facility information, telephone number information, and the like.

Further, the second map information 150 may be updated at any time by the communication device 30 communicating with another device. For example, when the vehicle M enters the parking lot PA, the communication device 30 receives information (hereafter, also referred to as in-parking-lot map information) indicating the lane in the parking lot PA, the position of each parking space, and the like from the parking lot management device 400. Then, the automatic driving control device 100 updates the second map information 150 so as to incorporate the received in-parking-lot map information into the second map information 150. As a result, the automatic driving control device 100 can specify the position of each parking space in the parking lot PA with reference to the second map information 150.

The environment recognition unit 110 performs sensor fusion processing on information acquired by a part or all of the camera 11, the radar device 12, and the finder 13, in such a manner that the environment recognition unit 110 recognizes an object around the vehicle M and recognizes its position. The environment recognition unit 110 recognizes, for example, an obstacle, a road shape, a traffic light, a guardrail, a utility pole, a surrounding vehicle (including traveling conditions such as speed and acceleration and parking conditions), a lane mark, a pedestrian, and the like and recognizes their positions.

Referring to the position of the vehicle M specified by the navigation device 40, the detection result by the vehicle sensor 14, the image taken by the camera 11, the second map information, and the like, the high-precision position recognition unit 120 recognizes the detailed position and attitude of the vehicle M. The high-precision position recognition unit 120 recognizes, for example, the traveling lane in which the vehicle M is traveling or recognizes the relative position and attitude of the own vehicle with respect to the traveling lane. Further, the high-precision position recognition unit 120 also recognizes, for example, the position of the vehicle M in the parking lot PA.

The action plan generation unit 130 generates an action plan for the vehicle M. Specifically, the action plan generation unit 130 generates a target track on which the vehicle M will travel in the future as an action plan of the vehicle M. The target track is, for example, information in which points (track points) to be reached by the vehicle M are arranged for each predetermined traveling distance (for example, about several [m]). Further, the target track may include information on speed elements such as the target speed and the target acceleration of the vehicle M at each predetermined time or at each track point. The action plan generation unit 130 generates an action plan according to the instructions of the parking lot management device 400 received by the communication device 30, for example.

The action control unit 140 controls the vehicle M to act according to the action plan generated by the action plan generation unit 130. Specifically, the action control unit 140 controls the traveling driving force output device 200, the brake device 210, and the steering device 220 so that the vehicle M passes the target track generated by the action plan generation unit 130 at the scheduled time. The action control unit 140 controls, for example, the traveling driving force output device 200 and the brake device 210 based on the speed element associated with the target track and controls the steering device 220 according to a curvature degree of the target track.

Each functional unit included in the automatic driving control device 100 is realized, for example, by the Central Processing Unit (CPU) executing a predetermined program (software). Further, a part or all of the functional units of the automatic driving control device 100 may be realized by hardware such as Large Scale Integration (LSI), Application Specific Integrated Circuit (ASIC), Field-Programmable Gate Array (FPGA), Graphics Processing Unit (GPU), and for example, the storage device for storing the second map information 150 and the high-precision position recognition unit 120 may be realized by a Map Positioning Unit (MPU). Further, a part or all of the functional units of the automatic driving control device 100 may be realized by the cooperation of software and hardware.

Parking Lot Managed by Parking Lot Management Device

Figure 2:
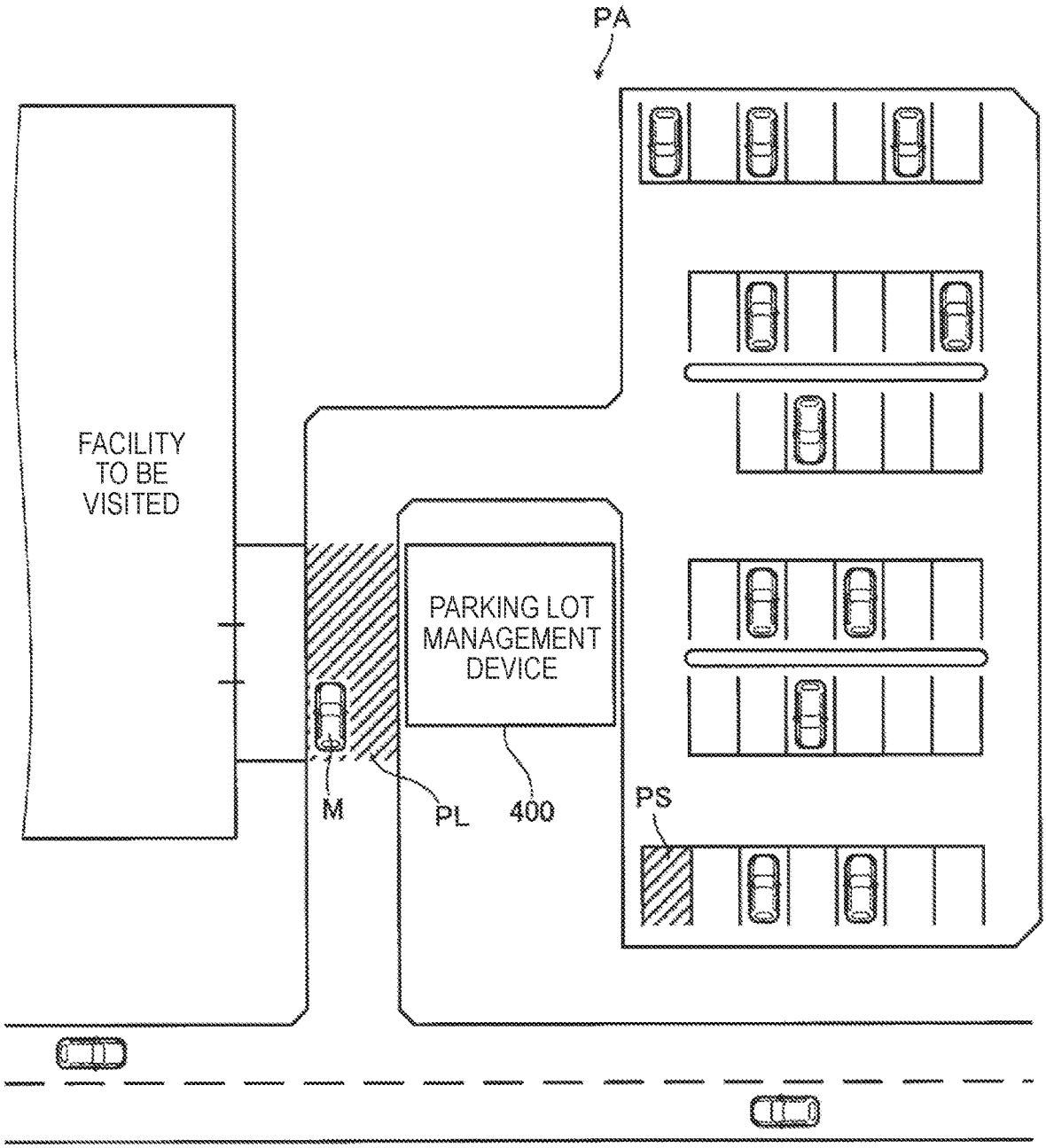
FIG. 2 is a diagram illustrating an example of a parking lot managed by a parking lot management device.

Next, an example of the parking lot PA will be described with reference to FIG. 2. As illustrated in FIG. 2, the parking lot PA is a parking lot managed by the parking lot management device 400 and is an automatic valet parking type parking lot attached to a visited facility to be visited by a user. The parking lot PA includes a plurality of parking spaces PS where a vehicle (for example, vehicle M) can be accommodated and a platform PL provided right before the plurality of parking spaces PS. Hereinafter, an example in which a user of the vehicle M uses the parking lot PA will be described.

Before using the parking lot PA, the user of the vehicle M uses the terminal device 300 to make a reservation (hereinafter, also referred to as a parking reservation) for using the parking lot PA to the parking lot management device 400 which manages the parking lot PA. For example, the user of the vehicle M inputs the date and time when the parking lot PA is used and the identification information of the vehicle M into the terminal device 300 and sends the information to the parking lot management device 400, so that the reservation for using the parking lot PA is made. Then, when it comes to the date and time of the usage reservation, the user of the vehicle M rides the vehicle M on the platform PL and gets off from the vehicle M on the platform PL.

After the user gets off the vehicle M, the vehicle M automatically drives and starts a self-propelled parking event to move to the parking space PS in the parking lot PA. For example, the user uses the terminal device 300 to send a request to start the self-propelled parking event to move to the parking space PS to the parking lot management device 400. In response to this start request, the parking lot management device 400 instructs vehicle M to perform the self-propelled parking event for parking the vehicle M in a predetermined parking space PS. According to this instruction, the vehicle M moves to the parking space PS instructed by the parking lot management device 400 while being guided by the parking lot management device 400 or sensing with the camera 11, the radar device 12, the finder 13, or the like.

In addition, the vehicle M can carry out re-parking, so-called "reparking", in which the parking position is changed to another parking position while the vehicle M is parked in the parking lot PA. This reparking is appropriately carried out by an instruction from the parking lot management device 400 or by voluntary automatic driving by the vehicle M itself.

In addition, at the time of exiting from the parking lot PA, the vehicle M performs automatic driving and performs a self-propelled parking event to move from the parking space PS to the platform PL. For example, the user uses the terminal device 300 to send a request to start the self-propelled parking event for moving the vehicle M to the platform PL to the parking lot management device 400. In response to this start request, the parking lot management device 400 instructs the vehicle M to perform the self-propelled parking event for moving the vehicle M from the parking space PS where the vehicle M is parked to the platform PL. According to this instruction, the vehicle M moves to the platform PL while being guided by the parking lot management device 400 or sensing with the camera 11, the radar device 12, the finder 13, or the like. The user of the vehicle M gets on the vehicle M at the platform PL and exits from the parking lot PA.

Parking Lot Management Device

Figure 3:
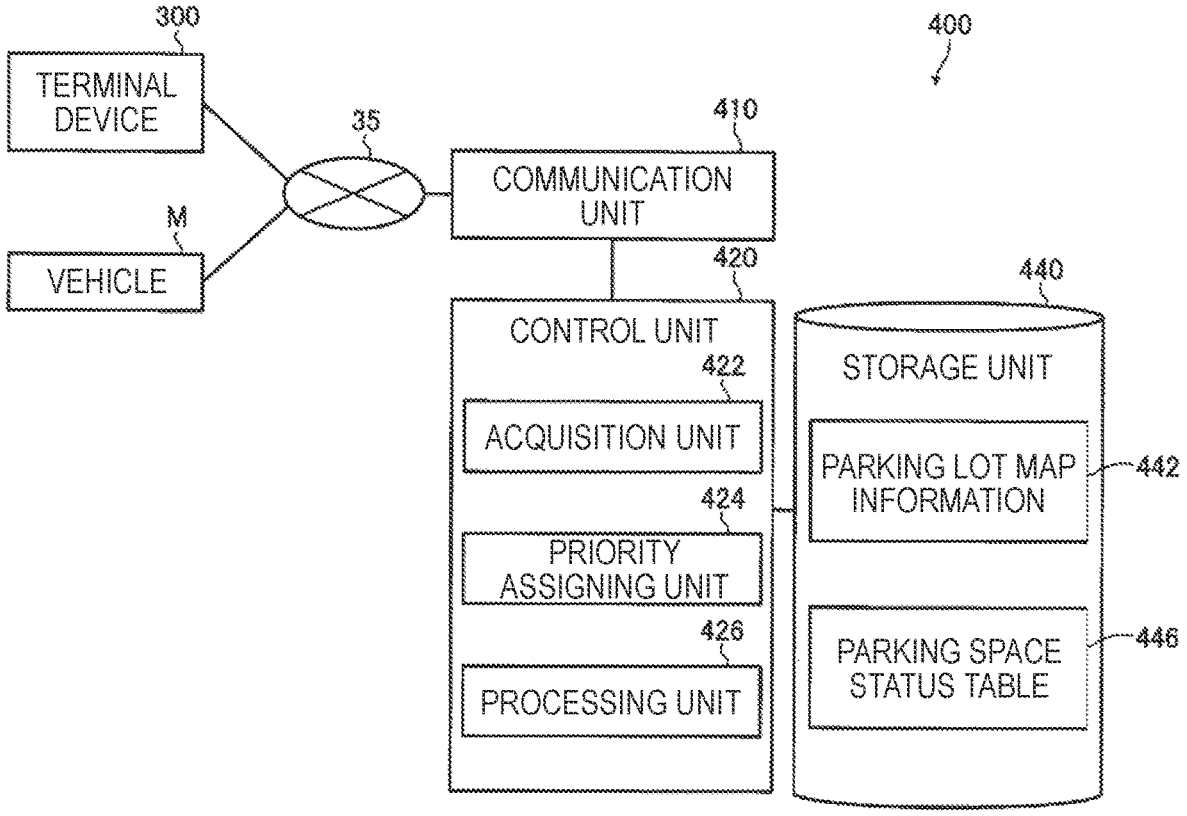
FIG. 3 is a diagram illustrating an example of a configuration of the parking lot management device.

Next, an example of the configuration of the parking lot management device 400 will be described with reference to FIG. 3. As illustrated in FIG. 3, the parking lot management device 400 includes, for example, a communication unit 410, a control unit 420, and a storage unit 440. The control unit 420 includes, for example, an acquisition unit 422, a determination unit 424, and a processing unit 426. Each component of the control unit 420 is realized, for example, by a hardware processor such as a CPU executing a program (software). Some or all of those components may be realized by hardware (circuit part: including circuitry) such as LSI, ASIC, FPGA, and GPU or may be realized by collaboration between software and hardware. The program may be stored in advance in a storage device (a storage device including a non-transient storage medium) such as an HDD or a flash memory, or the program may be stored in a removable storage medium (a non-transient storage medium) such as a DVD or a CD-ROM and installed by attaching the storage medium to a drive device.

Information such as parking lot map information 442 and parking space status table 446 is stored in the storage unit 440. The storage unit 440 is realized by an HDD, a flash memory, or the like.

The communication unit 410 wirelessly (for example, network 35) communicates with the vehicle M or the user's terminal device 300. The control unit 420 guides the vehicle M to the parking space PS based on the information acquired by the communication unit 410 and the information stored in the storage unit 440. The parking lot map information 442 is information which geometrically represents the structure of the parking lot PA. Further, the parking lot map information 442 includes the coordinates for each parking space PS.

Figures 4, 5:
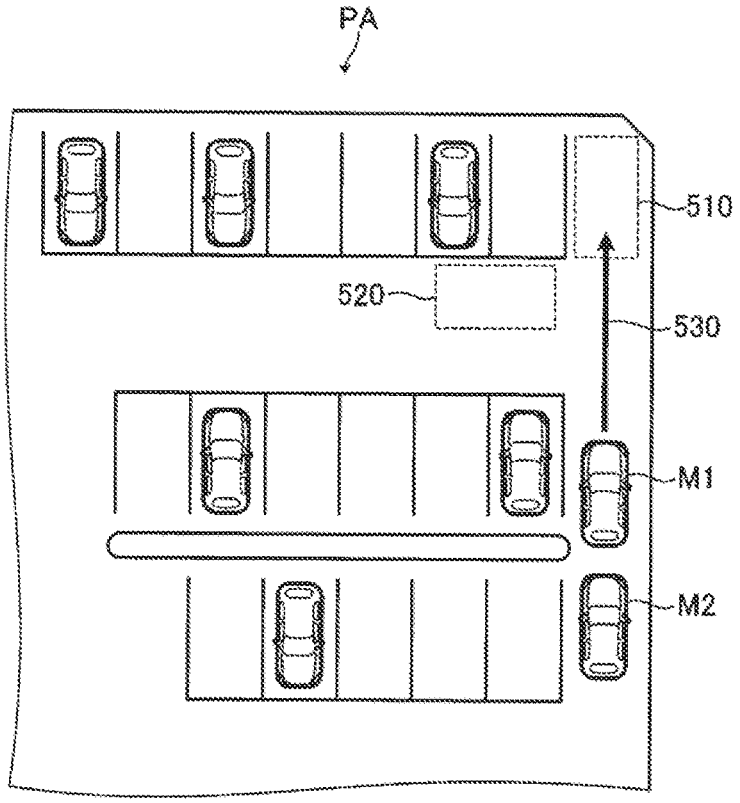
FIG. 4 is a diagram illustrating an example of a parking space status table.
FIG. 5 is a diagram illustrating an example of a parking frame which does not require steering input.

The acquisition unit 422 acquires the position information of the vehicle M already parked in the parking lot PA via the communication unit 410. This position information is stored, for example, in the form of the parking space status table 446. As illustrated in FIG. 4, in the parking space state table 446, for example, information indicating whether the parking space PS is empty or full (parked), the vehicle ID which is the identification information of the parked vehicle M when the parking space PS is full, and the entry time and scheduled exit time of the vehicle M when the parking space PS is full are associated with the parking space ID which is the identification information of the parking space PS. The entry time and the scheduled exit time are recorded, for example, in association with the vehicle ID of the vehicle M when the vehicle M enters the parking lot PA. The vehicle ID can be, for example, a vehicle number written on a vehicle number plate (so-called license plate).

In addition, the acquisition unit 422 also acquires the position information of the vehicle M traveling in the parking lot PA. The vehicle M traveling in the parking lot PA periodically transmits information associating the vehicle ID of the own vehicle with the position (for example, the position recognized by high-precision position recognition unit 120) of the own vehicle in the parking lot PA to the parking lot management device 400. The acquisition unit 422 acquires information in which the vehicle ID transmitted from the vehicle M traveling in the parking lot PA and the position in the parking lot PA are associated with each other via the communication unit 410. Further, when the parking lot management device 400 receives the information in which the vehicle ID and the position in the parking lot PA are associated with each other from the vehicle M traveling in the parking lot PA, the parking lot management device 400 may store the received information in a predetermined table of the storage unit 440. Then, the acquisition unit 422 may acquire the position information of the vehicle M traveling in the parking lot PA with reference to this table.

First Control Example

Next, a first control example of the parking lot management device 400 will be described. For example, a situation may occur in which a plurality of vehicles M are traveling in the parking lot and a traffic jam occurs, and further a convoy of vehicles is formed. Each vehicle M travels according to a preset predetermined traveling speed in a self-propelled parking event under the control of the parking lot management device 400, but such a traveling speed is generally set according to the traveling performance of the vehicle M in a state of the self-propelled parking event. The traveling performance of the vehicle M in the state of the self-propelled parking event depends on, for example, a processing performance of the automatic driving control device 100 and a sensing performance of the camera 11, the radar device 12, the finder 13, the vehicle sensor 14, and the like.

When a situation occurs in which a plurality of vehicles M form a convoy, for example, when a vehicle M with a low set traveling speed exists near the beginning of the convoy, the movement speed of the entire convoy may decrease and the vehicle M belonging to the convoy may not be able to travel efficiently in the parking lot PA. Therefore, leaving such a state unattended is not preferable from the viewpoint of effective utilization of the parking lot PA.

Therefore, a priority assigning unit 424 assigns a priority to each of the plurality of vehicles M traveling in the parking lot PA according to the order in which each vehicle M is traveled. When the priority assigning unit 424 determines, for example, that a plurality of vehicles M traveling in the parking lot PA form a convoy based on the position information of the vehicle M traveling in the parking lot PA acquired by the acquisition unit 422, each of these plurality of vehicles M is given a priority according to the order in which each vehicle M is traveled. Further, the priority assigning unit 424 assigns a priority to each vehicle M according to a set movement performance set in advance for each vehicle M. The set movement performance is the performance according to the index related to the movement of the vehicle, which is set exclusively for the vehicle M traveling in the parking lot PA, and is, for example, the maximum value of the traveling speed and the steering angle.

That is, the priority assigning unit 424 gives each vehicle M a priority that reflects the set movement performance, in such a manner that when a situation such as convoy traveling occurs, the traveling order of the vehicles can be set appropriately according to the set movement performance. As a result, for example, the vehicle M having high set movement performance can be preferentially traveled and quickly guided to a predetermined parking position. As a result, all or some of the vehicles M belonging to the convoy can be parked smoothly. However, the priority assigning unit 424 can give a priority to each vehicle M even when a plurality of vehicles M do not form a convoy at first glance. In addition, even when a plurality of vehicles M do not form a convoy at the present time, if these plurality of vehicles M are expected to form a convoy in the future, the priority assigning unit 424 may give a priority to each vehicle M before the plurality of vehicles M form a convoy.

When the set movement performance is the set traveling speed set for the vehicle M traveling in the parking lot PA, the priority assigning unit 424 can give a lower priority to the vehicle M having a low set traveling speed than to the vehicle M having a high set traveling speed. For example, when there is a vehicle M with a low set traveling speed near the beginning of the convoy, by taking measures such as exchanging the traveling order (for example, the positions of vehicles M in the convoy) of vehicles M, the convoy of the vehicles M can be formed in the order of the set traveling speed. As a result, the vehicle M having a high set traveling speed can be preferentially traveled and quickly guided to a predetermined parking position, and as a result, all or some of the vehicles M belonging to the convoy can be smoothly parked.

When a plurality of vehicles M are continuously traveled while maintaining a constant interval, the priority assigning unit 424 may arrange the vehicle M having the lowest set traveling speed at the end. Therefore, it prevents the vehicle M with the lowest set traveling speed from lowering the movement efficiency of the entire convoy formed by the plurality of vehicles M kept at constant intervals and preferentially makes the vehicle M with the highest set traveling speed travel, and thus the vehicle M with the high set traveling speed can be quickly guided to a predetermined parking position. As a result, all or some of the vehicles M belonging to the convoy can be parked smoothly.

For example, the priority assigning unit 424 may temporarily retract the vehicle M having a set traveling speed lower than a predetermined traveling speed to a predetermined parking frame in order to change the order of the vehicles traveling in a convoy. Here, the parking frame is an area provided in the parking lot PA where the vehicle M can be retracted. For example, the parking frame may be a dedicated area provided in the parking lot PA as a parking frame, may be a parking space PS, or may be a part of a passage in the parking lot PA where the vehicle M can travel. A vehicle M, which has a low set traveling speed, may reduce the movement efficiency of the entire convoy. However, by retracting the vehicle M to the predetermined parking frame, it is possible to prevent the movement efficiency of the entire convoy from being lowered.

For example, when a vehicle M having a low set traveling speed (that is, a low priority) is traveling ahead of a vehicle M having a high set traveling speed (that is, a high priority), it is desirable that the priority assigning unit 424 temporarily retracts the vehicle M having the low set traveling speed to a predetermined parking frame. By retracting the vehicle M having the low set traveling speed to the parking frame, the vehicle M having the high set traveling speed can easily overtake the vehicle M having the low set traveling speed. As a result, the positions of those vehicles M in the convoy can be changed smoothly.

The priority assigning unit 424 may start the vehicle M having a lower priority than that of the vehicle M having a higher priority after the traveling to the destination of the vehicle M having the higher priority is completed. The priority assigning unit 424 starts, for example, the vehicle M to which the lowest priority is given after the completion of traveling of the plurality of vehicles M to which the priorities are given higher than that of the vehicle M having the lowest priority is completed. As a result, the plurality of vehicles M can be smoothly traveled in the parking lot PA.

When the vehicle M is retracted, the priority assigning unit 424 may retract the vehicle M to a parking frame where the steering change amount is less than a predetermined amount. By retracting the vehicle M to a place where the steering change amount, that is, the turning amount is small or unnecessary (the steering change amount is zero), the time required for retracting can be shortened. For example, as illustrated in FIG. 5, in order to give priority to a vehicle M2 having a high priority because the set traveling speed is high, a vehicle M1 traveling in front of the vehicle M2 may be retracted. Here, the vehicle M1 is a vehicle M having a lower priority than that of the vehicle M2 because the set traveling speed is lower. In this case, a first parking frame 510 and a second parking frame 520 are considered as candidates for the parking frame for retracting the vehicle M1.

The first parking frame 510 is a parking frame located directly in front of the vehicle M1 and is a parking frame which does not require a steering change when the vehicle M1 is retracted. On the other hand, the second parking frame 520 is a parking frame located in front of the left side of the vehicle M1 and is a parking frame which requires a steering change to turn left when retracting the vehicle M1. In such a case, the priority assigning unit 424 causes the vehicle M1 to be retracted to the first parking frame 510 as illustrated by the arrow of reference numerals 530 in FIG. 5.

Further, the priority assigning unit 424 may cause vehicles M having similar set movement performances to be grouped to form a convoy and each convoy may be traveled in the parking lot PA. Since the vehicles M having similar set movement performances belong to the group, the distance between the head and the end of the group does not increase, and as a result, the entire group can move smoothly. The range of set movement performances of the vehicles to be grouped can be arbitrarily set.

The priority assigning unit 424 may give a lower priority than that of the vehicle M having a large maximum steering angle to the vehicle M having a small maximum possible steering angle (hereinafter, also simply referred to as the maximum steering angle). The vehicle M, which has a large maximum steering angle, has a so-called small turning radius as compared to the vehicle M, which has a small maximum steering angle, so it is considered that the vehicle M can travel smoothly in the parking lot PA. Therefore, the vehicle M having a large steering angle can be preferentially traveled and quickly guided to a predetermined parking position, and as a result, all or some of the vehicles M belonging to the convoy can be smoothly parked.

As described above, the parking lot management device 400 of the embodiment gives priority to each of the plurality of vehicles M traveling in the parking lot PA according to the order in which each vehicle M is driven. Upon assigning the priority, the parking lot management device 400 assigns the priority to each vehicle M according to a predetermined set movement performance preset for each vehicle M. As a result, it is possible to form a convoy of the vehicles M according to the order of the set movement performance and all or some of the vehicles M belonging to the convoy can be smoothly traveled in the parking lot PA, and thus, for example, it enables smooth parking of those vehicles M. As a result, the parking lot PA can be used more effectively.

In the embodiment described above, the case where a plurality of vehicles M traveling in the parking lot PA form a convoy is described as an example. However, the priority assigning unit 424 of the parking lot management device 400 can give a priority to each vehicle M even when a plurality of vehicles M do not form a convoy at first glance. Even when the convoy is not formed, by giving a priority with the priority assigning unit 424, the vehicle M is traveled according to the set traveling speed, and as a result, it is expected that all or some of the moving vehicles M will be parked smoothly.

The processing unit 426 acquires the position of the parking space PS where each vehicle M should be parked from the parking lot map information 442 while referring to the parking space status table 446, and then the processing unit 426 transmits a suitable route to the position of the acquired parking space PS to the vehicle M using the communication unit 410.

In the vehicle M which receives the route, the action plan generation unit 130 generates a target track based on the route. The action control unit 140 controls the vehicle M to act according to the action plan generated by the action plan generation unit 130 and parks the vehicle M in the parking space PS.

Processing Flow of First Control Example

Figure 6:
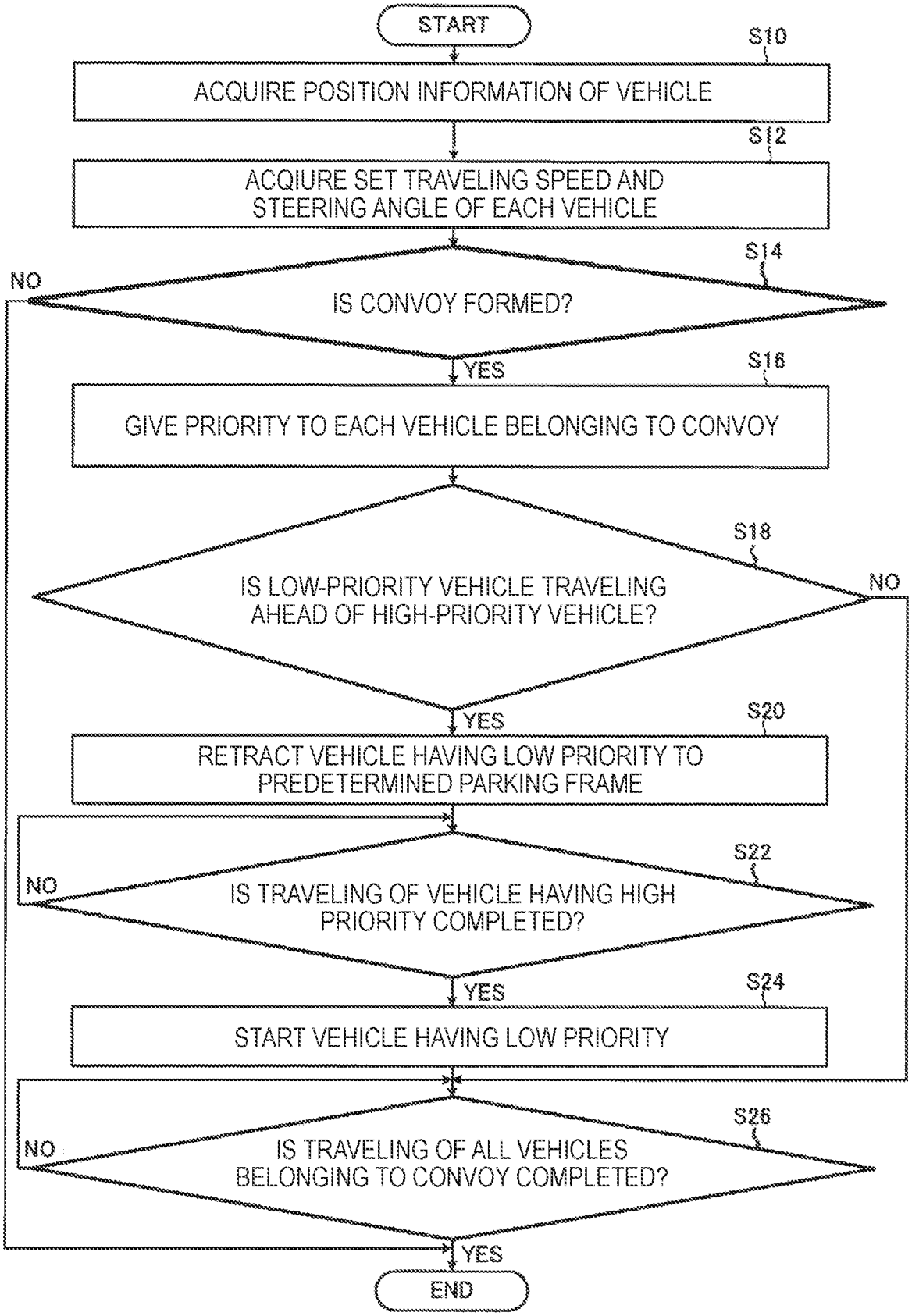
FIG. 6 is a flowchart illustrating a series of processing flows of the parking lot management device based on a first control example.

Hereinafter, a series of processing flows of the parking lot management device 400 based on the first control example will be described with reference to a flowchart. FIG. 6 is a flowchart illustrating the series of processing flows of the parking lot management device 400. The processing of this flowchart may be repeated at a predetermined cycle.

First, the acquisition unit 422 acquires the position information of the vehicle M traveling in the parking lot PA via the communication unit 410 (Step S10).

Further, the acquisition unit 422 acquires, in addition to the position information of the vehicle M, information indicating the set traveling speed and the maximum value of the steering angle as the set movement performance from each vehicle M (Step S12). Information indicating the set traveling speed and the maximum value of the steering angle can be acquired together with the acquisition of the position information. It is also possible for a user to use the terminal device 300 to transmit information indicating the set traveling speed and the maximum value of the steering angle to the parking lot management device 400 in advance, and then the information can be received by the communication unit 410 and stored in a predetermined table of the storage unit 440. In this case, the priority assigning unit 424 refers to the table and acquires the information indicating the set traveling speed and the maximum value of the steering angle.

Next, the priority assigning unit 424 determines whether a plurality of vehicles M form a convoy based on the position information acquired in Step S10 (Step S14). Whether to form a convoy differs depending on the specific situation, but for example, there is a case where a plurality of vehicles M travel in succession while maintaining a certain interval. When a convoy is not formed (NO in Step S14), the processing of the flowchart illustrated in FIG. 6 ends. On the other hand, when a convoy is formed (YES in Step S14), the priority assigning unit 424 assigns a priority to each vehicle M belonging to the convoy according to the information indicating the set traveling speed and the maximum value of the steering angle acquired in Step S12 (Step S16).

When assigning the priority, the priority assigning unit 424 basically assigns the priority according to the set traveling speed. That is, the priority assigning unit 424 can give a lower priority to the vehicle M having a low set traveling speed than to the vehicle M having a high set running speed. In addition, the priority assigning unit 424 assigns the lowest priority to the vehicle M having the lowest set traveling speed so that the vehicle M having the lowest set traveling speed is placed at the end of the convoy.

Also, when there are a plurality of vehicles with the same set traveling speed, the priority assigning unit 424 may give a vehicle M having a small maximum steering angle a lower priority than a vehicle M having a large maximum steering angle. The priority assigning unit 424 may make the vehicles M having similar set traveling speeds grouped to form a convoy and each convoy may be traveled in the parking lot PA. The range of setting speeds of the vehicles to be grouped can be set arbitrarily.

Next, based on the position information of each vehicle M belonging to the convoy acquired in Step S10 and the priority of each vehicle M belonging to the convoy assigned in Step S16, the priority assigning unit 424 determines whether the vehicle M having a low priority is traveling ahead of the vehicle M having a high priority (Step S18). When the vehicle M having a low priority is not traveling ahead of the vehicle M having a high priority (NO in Step S18), the process proceeds to Step S26.

On the other hand, when the vehicle M having a low priority is traveling ahead of the vehicle M having a high priority (YES in Step S18), the priority assigning unit 424 causes the vehicle M having a low priority to be temporarily retracted to a predetermined parking frame (Step S20). Further, when the vehicle M is retracted, the priority assigning unit 424 may cause the vehicle M to be retracted to a parking frame where the steering change amount is smaller than a predetermined amount (including zero).

Next, the priority assigning unit 424 determines whether the traveling of the vehicle M having a high priority is completed (Step S22). In Step S22, the priority assigning unit 424 determines affirmatively when, for example, parking or exiting the vehicle having a high priority to or from a predetermined parking position is completed. Further, in Step S22, the priority assigning unit 424 may simply make an affirmative determination when the overtaking of the low-priority vehicle M by the high-priority vehicle M is completed.

When the traveling of the vehicle M having a high priority has not been completed (NO in Step S22), the priority assigning unit waits until the traveling of the vehicle M having a high priority is completed. Then, when the traveling of the vehicle M having a high priority is completed (YES in Step S22), the priority assigning unit 424 starts the vehicle M (for example, vehicle M which has been retracted) having a low priority (Step S24).

Next, the priority assigning unit 424 determines whether the traveling of all vehicles M belonging to the convoy is completed (Step S26). When the traveling of all vehicles M belonging to the convoy is not completed (NO in Step S26), the priority assigning unit waits until the traveling of all vehicles M is completed. Then, when the traveling of all vehicles M is completed (YES in Step S26), the processing of the flowchart illustrated in FIG. 6 is completed.

In addition, in Step S20 and after in the example described above, the priority assigning unit 424 waits for the completion of the traveling of the vehicle M having a high priority, and then starts the vehicle M having a low priority. However, the priority assigning unit 424 does not wait for the completion of the traveling of the vehicle M having a high-priority and, for example, the priority assigning unit 424 may make the retracted low-priority vehicle M travel behind the high-priority vehicle M to form a new convoy and completes the traveling by traveling the convoy of all vehicles M.

Second Control Example

Next, a second control example of the parking lot management device 400 will be described. In the first control example described above, the parking lot management device 400 assigns a priority to each of the plurality of vehicles M according to the order of traveling according to a predetermined set movement performance preset for each vehicle M. On the other hand, in the second control example, the parking lot management device 400 gives a priority to each vehicle M according to a destination of the vehicle M in the parking lot PA. The destination of the vehicle M is, for example, the platform PL or each parking space PS.

For example, the movement from any parking space PS to the platform PL as a destination can be considered as the movement for the purpose of exiting from the parking lot PA. In addition, the movement from the platform PL to any parking space PS as the destination can be considered as the movement for the purpose of entering the parking lot PA. In addition, the movement from the parked parking space PS to another parking space PS as the destination is considered as the movement for the purpose of reparking.

That is, in the second control example, the priority assigning unit 424 assigns a priority to each vehicle M according to the destination of each vehicle M in the parking lot PA. The priority assigning unit 424 gives each vehicle M a priority which reflects the destination, in such a manner that the traveling order of the vehicles M traveling on the parking lot PA can be appropriately set according to the situation according to the destination of each vehicle M. Thus, the vehicle M leaving the parking lot PA like exiting from the parking lot PA, for example, can be preferentially traveled and the other vehicle M can be guided to a predetermined parking position. As a result, all or some of the vehicles M in the parking lot PA can be smoothly traveled or parked.

The purpose of going to the destination includes, for example, at least one of the purpose of exiting from the parking lot PA, the purpose of entering the parking lot PA, and the purpose of re-parking including moving in the parking lot PA. The exit from the parking lot PA and the entry into the parking lot PA are the main purposes (the purpose of going to the destination) of moving the vehicle M and are indispensable for the use of the parking lot PA. In addition, "re-parking including movement in the parking lot PA" corresponds to re-parking in which the parking position of the vehicle M already parked is changed to another parking position in the parking lot PA, so-called "repacking" and contributes to the effective utilization of the parking lot PA.

In the second control example, the parking lot management device 400 stores information in which the vehicle ID of each vehicle M in the parking lot PA and the purpose of movement are associated with each other in the storage unit 440. For example, the parking lot management device 400 stores the vehicle ID of the vehicle M to be moved from the platform PL to a predetermined parking space PS in the storage unit 440 in association with the movement purpose "entry-purpose". Further, the parking lot management device 400 stores the vehicle ID of the vehicle M to be moved from a predetermined parking space PS to the platform PL in the storage unit 440 in association with the movement purpose "exit purpose". Then, the parking lot management device 400 associates the vehicle ID of the vehicle M which changes (for example, move from first parking space PS to second parking space PS) the parking position with the movement purpose "re-parking purpose" and stores it in the storage unit 440. Thereby, in the second control example, the acquisition unit 422 can acquire the information indicating the movement purpose of each vehicle M by referring to the storage unit 440.

The priority assigning unit 424 can give the highest priority to the vehicle M having the exit purpose and the lowest priority to the vehicle M having the re-parking purpose. As a result, the vehicle M having the exit purpose can be preferentially traveled and quickly guided to exiting. For the vehicle M having the purpose of exiting from the parking lot PA, a user waits for the exiting and stands by. Thus, by giving such a vehicle M a high priority, the convenience of a user can be improved. In addition, it is possible to make the vehicle M having the purpose of re-parking travel behind and prevent a situation in which the movement of other vehicles is hindered by the time-consuming re-parking process. The priority of the vehicle M having the purpose of entering the parking lot PA is between the priority of the vehicle M having the purpose of exiting from the parking lot PA and the priority of the vehicle M having the purpose of re-parking. As a result, all or some of the vehicles M in the parking lot PA can be smoothly traveled or parked, and thus the parking lot PA can be effectively utilized.

When there are a predetermined number or more of vehicles M having an exit purpose and vehicles M having an entry purpose, the priority assigning unit 424 can make the vehicles M having a re-parking purpose stand by without traveling before heading to the destination. When there are a large number of vehicles M having an exit purpose and vehicles M having an entry purpose, re-parking which takes a long time may prolong the processing. Therefore, by making the vehicle M re-parked stand by at a predetermined position even temporarily, it is possible to prioritize the processing of the vehicle M having the exit purpose and the vehicle M having the entry purpose and smoothly complete the traveling of the vehicle M having the exit purpose and the vehicle M having the entry purpose.

When the vehicle M having the entry purpose stops at the parking position of the vehicle M having the re-parking purpose, it is desirable that the priority assigning unit 424 raises the priority of the vehicle M having the re-stopping purpose. In the above description, the vehicle M having the re-parking purpose is generally given a lower priority. However, when the principle is adhered to, even when another vehicle M wishes to park at the parking position of the vehicle M having the re-parking purpose, it cannot be parked smoothly. Therefore, in such a special case, another vehicle M can be smoothly parked by preferentially making the vehicle M having a stopping purpose travel.

When a plurality of vehicles M are traveled and the vehicle M having a lower priority interferes with the traveling of the vehicle M having a higher priority, the priority assigning unit 424 temporarily retracts the vehicle M having the low priority to a predetermined parking frame. As a result, the vehicle M having the high priority can be preferentially traveled, and as a result, all or some of the vehicles M can be smoothly parked in the parking lot PA.

When the vehicle M is retracted, it is desirable that the priority assigning unit 424 preferentially selects a parking position which does not require steering input. The vehicle M can be quickly parked at the parking position which does not require steering input, that is, turning, and as a result, all or some of the vehicles M belonging to the convoy can be smoothly traveled or parked.

Further, it is desirable that the priority assigning unit 424 assigns a priority to each vehicle M for each partial area in the parking lot PA. For example, the processing load of the parking lot management device 400 can be reduced by determining the priority for each partial area in the parking lot PA such as a traveling area and a passage.

Further, the priority assigning unit 424 does not have to give a priority to the vehicle M whose traveling route in the parking lot PA does not interfere with other vehicles M. As a result, the processing load of the parking lot management device 400 can be reduced.

As described above, the parking lot management device 400 of the embodiment gives a priority to each of the plurality of vehicles M traveling in the parking lot PA according to the destination of each vehicle M. As a result, it is possible to form a convoy of the vehicles M according to the type of the destination, and thus all or some of the vehicles M in the parking lot PA can be smoothly traveled or parked. As a result, the parking lot PA can be used more effectively.

In the embodiment described above, the case where a plurality of vehicles M traveling in the parking lot PA form a convoy is described as an example. However, the priority assigning unit 424 of the parking lot management device 400 can give a priority to each vehicle M even when a plurality of vehicles M do not form a convoy at first glance. By giving a priority with the priority assigning unit 424 even when no convoy is formed, it is expected that the vehicle M will be traveled according to the purpose of movement, and as a result, all or some of the moving vehicles M will be parked smoothly.

Processing Flow of Second Control Example

Figure 7:
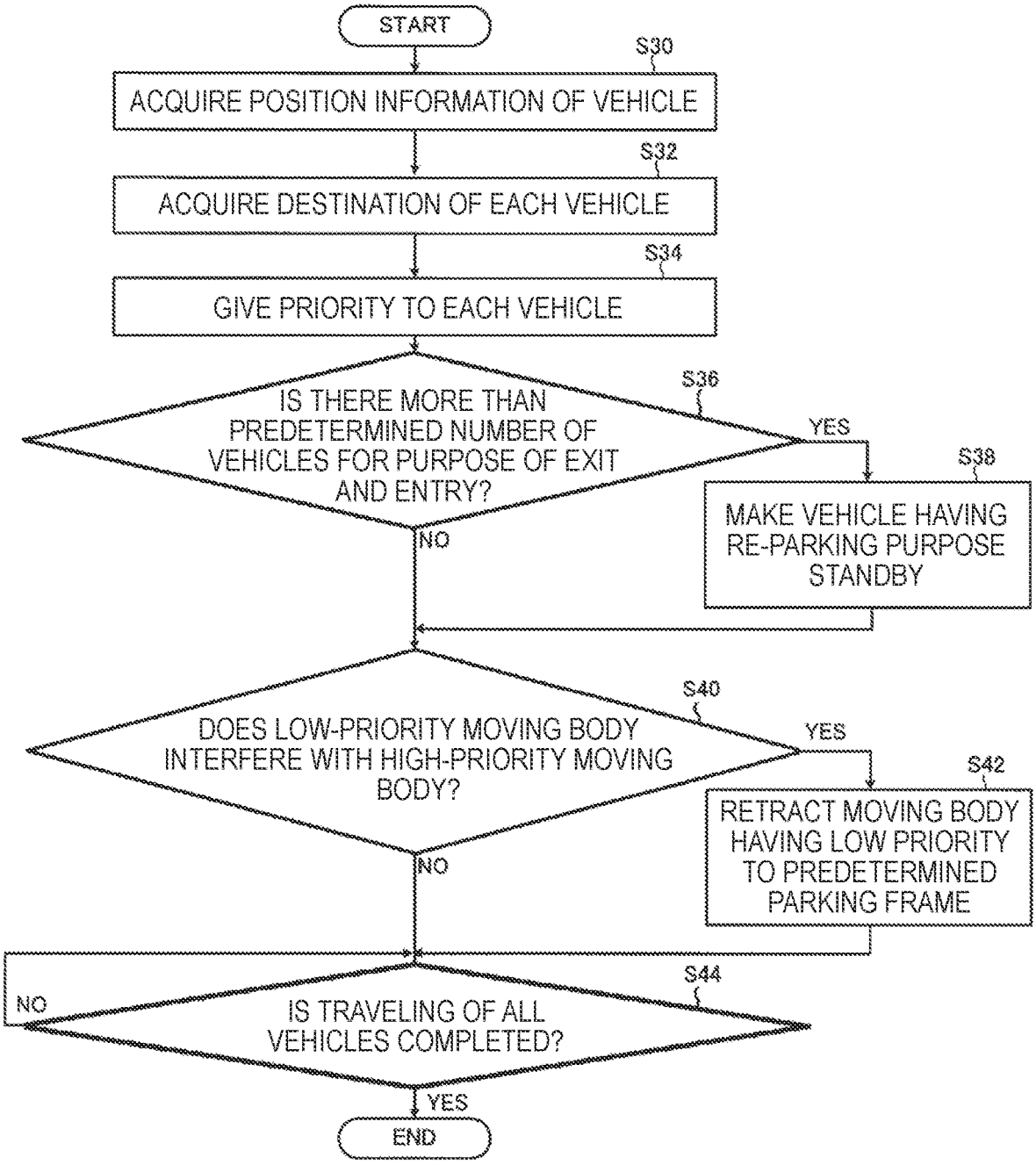
FIG. 7 is a flowchart illustrating a series of processing flows of the parking lot management device based on a second control example.

Hereinafter, a series of processing flows of the parking lot management device 400 based on the second control example will be described with reference to a flowchart. FIG. 7 is a flowchart illustrating the series of processing flows of the parking lot management device 400. The processing of this flowchart may be repeated at a predetermined cycle.

First, the acquisition unit 422 acquires the position information of the vehicle M in the parking lot PA via the communication unit 410 (Step S30). Further, the acquisition unit 422 acquires the destination of the vehicle in the parking lot PA with reference to the storage unit 440 (Step S32).

The priority assigning unit 424 assigns a priority to each vehicle M according to the destination acquired in Step S32, particularly the purpose of going to the destination (Step S34). The purpose of going to the destination includes, for example, the purpose of exiting from the parking lot PA, the purpose of entering the parking lot PA, the purpose of re-parking including the movement in the parking lot PA, and the like, but the purpose is not limited to such a purpose. The priority assigning unit 424 gives the highest priority to the vehicle M having the exit purpose and the lowest priority to the vehicle M having the re-parking purpose. The priority of the vehicle M having the purpose of entering the parking lot PA is between the priority of the vehicle M having the exit purpose and the priority of the vehicle M having the re-parking purpose. However, when the vehicle M having the entry purpose stops at the parking position of the vehicle M having the re-parking purpose, the priority of the vehicle M having the re-stopping purpose is exceptionally raised.

Next, the priority assigning unit 424 determines whether there are a predetermined number or more of vehicles M having the exit purpose and vehicles M having the entry purpose (Step S36). When there are no more than the predetermined number of vehicles M having the exit purpose and vehicles M having the entry purpose (NO in Step S36), the process proceeds to Step S40. When there are more than the predetermined number of vehicles M having the exit purpose and vehicles M having the entry purpose (YES in Step S36), the priority assigning unit 424 causes the vehicle M having the re-parking purpose to stand by without traveling (Step S38) before heading to the destination and the process proceeds to Step S40. In addition, when the priority assigning unit 424 causes the vehicle M having the re-parking purpose to wait in Step S38, for example, if the traveling of the vehicle M having the exit purpose and the vehicle M having the entry purpose is completed, the priority assigning unit 424 allows the vehicle M having the re-parking purpose which has been kept on standby to travel.

Next, the priority assigning unit 424 determines whether the vehicle M having a low priority interferes with the traveling of the vehicle M having a high priority (Step S40). When the vehicle M having a low priority does not interfere with the traveling of the vehicle M having a high priority (NO in Step S40), the process proceeds to Step S44. When it is determined that the vehicle M having a low priority interferes with the traveling of the vehicle M having a high priority (YES in Step S40), the priority assigning unit 424 temporarily retracts the vehicle M having a lower priority to a predetermined parking frame (Step S42). In this case, the priority assigning unit 424 can preferentially select the parking position which does not require steering input and stop the vehicle M to the parking position. Then, When the vehicle M having a low priority is retracted to the predetermined parking frame in Step S42, the priority assigning unit 424, for example, causes the vehicle M having a low priority, which has been temporarily retracted, to travel when the traveling of the vehicle M having a high priority has been completed.

Next, the priority assigning unit 424 determines whether the traveling of all the vehicles M to which the priority has been given is completed (Step S44). When the traveling of all the vehicles M to which the priority has been given is not completed (NO in Step S44), the priority assigning unit waits until the traveling of those vehicles M is completed. When it is determined that the traveling of all the vehicles M to which the priority has been given is completed (YES in Step S44), the processing of the flowchart illustrated in FIG. 7 ends.

The priority assigning unit 424 may group vehicles M having the same movement purpose to form a convoy, and further, as in the first control example, the priority may be given according to the set traveling speed of each vehicle M belonging to this convoy, and then the priority assigning unit 424 may make the vehicles M travel in the parking lot PA in a traveling order according to this priority.

As described above, the parking lot management device 400 gives a priority to each vehicle M according to the traveling order under various situations in which a plurality of vehicles M are traveling in the parking lot PA. The assignment of the priority is determined according to the set traveling speed and the purpose of movement of each vehicle M. As a result, it becomes possible to smoothly carry out exiting and parking or re-parking in a predetermined parking space PS for a plurality of vehicles M, and thus the parking lot PA can be utilized more effectively.

In the embodiment described above, the so-called vehicle is given a priority of traveling in the parking lot. However, the idea of the present invention is not limited to such an embodiment and is also applied to a moving body (for example, a robot or the like) including a vehicle. That is, the present invention also includes a case where a priority is given in an accommodation area for accommodating a so-called moving body. Under this idea, "parking" is extended to the concept of "stop" and the "parking lot management device" of the embodiment is extended to the concept of "accommodation area management device". "Exit" and "entry" are extended to the concepts of "leave" and "enter". In addition, the repark includes an operation of "re-stopping to change the accommodation position of the stopped moving body to another accommodation position in the accommodation area".

Although the embodiment for carrying out the present invention is described above using the embodiment, the present invention is not limited to the embodiment and various modifications and substitutions can be made without departing from the gist of the present invention.

In addition, at least the following matters are described in this specification. The components and the like corresponding to those of the embodiment described above are shown in parentheses, but the present invention is not limited thereto.

(1) An accommodation area management device (parking lot management device 400) which manages an accommodation area (parking lot PA) for accommodating a moving body (vehicle M) and stops the moving body at a predetermined accommodation position (parking space PS) in the accommodation area, including:

a priority assigning unit (priority assigning unit 424) which assigns a priority to each of a plurality of moving bodies traveling in the accommodation area according to an order in which each moving body is traveled, where the priority assigning unit assigns the priority to each moving body according to a moving destination of each moving body in the accommodation area.

According to (1), by assigning the priority reflecting the destination to each moving body, the traveling order of the moving body can be appropriately set according to a situation according to the destination.

(2) The accommodation area management device according to (1), where a purpose of moving to the destination includes at least one of a purpose of leaving the accommodation area, a purpose of entering the accommodation area, and a purpose of re-stopping including movement in the accommodation area.

According to (2), as a result, all or some of the moving bodies can be stopped smoothly.

(3) The accommodation area management device according to (2), where the priority assigning unit gives a highest priority to the moving body having the leaving purpose and a lowest priority to the moving body having the re-stopping purpose.

According to (3), a user waits for the moving body for the purpose of leaving. Thus, by giving a high priority to such a moving body, the convenience of the user can be enhanced.

(4) The accommodation area management device according to (2) or (3), where the priority assigning unit causes the moving body having the re-stopping purpose to stand by without traveling before heading to the destination when there are a predetermined number or more of the moving bodies having the leaving purpose and the moving bodies having the entering purpose.

According to (4), the processing of the moving body having the leaving purpose and the moving body having the entering purpose can be prioritized, and as a result, all or some of the moving bodies can be stopped smoothly.

(5) The accommodation area management device according to any one of (2) to (4), where the priority assigning unit raises the priority of the moving body having the re-stopping purpose when the moving body having the entering purpose stops at the accommodation position of the moving body having the re-stopping purpose.

According to (5), another moving body can be smoothly stopped by preferentially traveling the moving body having the stopping purpose.

(6), The accommodation area management device according to any one of (1) to (5), where the priority assigning unit temporarily retracts a moving body having a low priority to a predetermined stop frame when a plurality of moving bodies are traveled and the moving body having a low priority interferes with traveling of a moving body having a high priority.

According to (6), the traveling of the moving body having a high priority can be preferentially carried out, and as a result, all or some of the moving bodies can be smoothly stopped.

(7) The accommodation area management device according to (6), where the priority assigning unit preferentially selects a stop frame which does not require steering input when retracting the moving body as the predetermined stop frame.

According to (7), the moving body can be stopped promptly at the accommodation position where the steering input is not required, and as a result, all or some of the moving bodies can be stopped smoothly.

(8) The accommodation area management device according to any one of (1) to (7), where the priority assigning unit assigns the priority to each moving body for each partial area in the accommodation area.

According to (8), the processing load of the accommodation area management device can be reduced.

(9) The accommodation area management device according to any one of (1) to (8), where the priority assigning unit does not assign a priority to a moving body whose traveling path in the accommodation area does not interfere with other moving bodies.

According to (9), the processing load of the accommodation area management device can be reduced.

What is claimed is:

1. An accommodation area management device configured to manage an accommodation area for accommodating a moving body and configured to stop the moving body at a predetermined accommodation position in the accommodation area, comprising:

a priority assigning unit configured to assign a priority to each of a plurality of moving bodies traveling in the accommodation area according to an order in which each moving body is traveled, wherein the priority assigning unit assigns the priority to each moving body according to a moving destination of each moving body in the accommodation area, the priority assigning unit gives a highest priority to the moving body which moves toward the moving destination to leave the accommodation area and a lowest priority to the moving body which moves toward the moving destination to change the accommodation position to another accommodation position in the accommodation area, and the priority assigning unit does not assign a priority to a moving body whose traveling path in the accommodation area does not interfere with other moving bodies.

2. The accommodation area management device according to claim 1, wherein the priority assigning unit causes the moving body which moves toward the moving destination to change the accommodation position to another accommodation position in the accommodation area to stand by without traveling before heading to the destination when there are a predetermined number or more of the moving bodies which moves toward the moving destination to leave the accommodation area and the moving bodies which moves toward the moving destination to enter into the accommodation area.

3. The accommodation area management device according to claim 1, wherein the priority assigning unit raises the priority of the moving body which moves toward the moving destination to change the accommodation position to another accommodation position in the accommodation area when the moving body which moves toward the moving destination to enter into the accommodation area stops at the accommodation position of the moving body which moves toward the moving destination to change the accommodation position to another accommodation position in the accommodation area.

4. The accommodation area management device according to claim 1, wherein the priority assigning unit temporarily retracts a moving body having a low priority to a predetermined stop frame when a plurality of moving bodies are traveled and the moving body having a low priority interferes with traveling of a moving body having a high priority.

5. The accommodation area management device according to claim 4, wherein the priority assigning unit preferentially selects a stop frame which does not require steering input when retracting the moving body as the predetermined stop frame.

6. The accommodation area management device according to claim 1, wherein the priority assigning unit assigns the priority to each moving body for each partial area in the accommodation area.

7. The accommodation area management device according to claim 1, wherein the plurality of moving bodies concurrently travel in a convoy within the accommodation area.

8. The accommodation area management device according to claim 7, wherein an order of the plurality of moving bodies in the convoy is formed according to priorities assigned to the moving bodies based on a respective set movement performance that is preset for each moving body.

9. The accommodation area management device according to claim 7, wherein the priorities of the plurality of moving bodies are set in order to allow the traveling order of the moving bodies traveling in the convoy within the accommodation area to be determined according to the respective moving destination of each moving body.

10. The accommodation area management device according to claim 1, wherein the priorities of the plurality of moving bodies are set in order to allow the traveling order of the moving bodies traveling in the accommodation area to be determined according to the respective moving destination of each moving body.

11. An accommodation area management device configured to manage an accommodation area for accommodating a moving body and configured to stop the moving body at a predetermined accommodation position in the accommodation area, comprising:

a priority assigning unit configured to assign a priority to each of a plurality of moving bodies traveling in the accommodation area according to an order in which each moving body is traveled, wherein the priority assigning unit assigns the priority to each moving body according to a moving destination of each moving body in the accommodation area, the priority assigning unit gives a highest priority to the moving body which moves toward the moving destination to leave the accommodation area and a lowest priority to the moving body which moves toward the moving destination to change the accommodation position to another accommodation position in the accommodation area, the plurality of moving bodies concurrently travel in a convoy within the accommodation area, and an order of the plurality of moving bodies in the convoy is formed according to priorities assigned to the moving bodies based on a respective set movement performance that is preset for each moving body.

* * * * *